US008274385B2

(12) United States Patent
Meier et al.

(10) Patent No.: US 8,274,385 B2
(45) Date of Patent: Sep. 25, 2012

(54) METHOD AND APPARATUS FOR CONTROLLING THE TIMING OF AN ALARM SIGNAL IN A SECURITY SYSTEM

(75) Inventors: Stein Arne Meier, Honefoss (NO); Alan Hayter, Victor, NY (US); Dennis Caler, Marion, NY (US)

(73) Assignees: Bosch Security Systems, Inc., Fairport, NY (US); Robert Bosch GmbH, Stuttgart (DE)

( * ) Notice: Subject to any disclaimer, the term of this patent is extended or adjusted under 35 U.S.C. 154(b) by 643 days.

(21) Appl. No.: 12/411,737

(22) Filed: Mar. 26, 2009

(65) Prior Publication Data

US 2010/0245088 A1 Sep. 30, 2010

(51) Int. Cl.
*G08B 13/08* (2006.01)

(52) U.S. Cl. ..... 340/545.1; 49/13; 116/85

(58) Field of Classification Search ..... 340/545.1, 340/545.2, 545.7, 545.8, 545.9, 507, 521, 340/522, 523; 49/13; 116/85, 86
See application file for complete search history.

(56) References Cited

U.S. PATENT DOCUMENTS

| | | | | |
|---|---|---|---|---|
| 4,136,338 | A * | 1/1979 | Antenore | 340/551 |
| 4,361,833 | A * | 11/1982 | Allgood | 340/533 |
| 5,390,144 | A * | 2/1995 | Susuki | 365/149 |
| 6,720,881 | B1 * | 4/2004 | Halliday | 340/573.4 |
| 6,812,836 | B2 | 11/2004 | Soloway et al. | |
| 7,298,253 | B2 * | 11/2007 | Petricoin et al. | 340/523 |
| 7,323,978 | B2 | 1/2008 | Parker et al. | |
| 7,916,018 | B2 * | 3/2011 | Eskildsen et al. | 340/545.1 |
| 7,965,171 | B2 * | 6/2011 | Hershkovitz | 340/5.2 |
| 2006/0181408 | A1 | 8/2006 | Martin | |
| 2008/0068162 | A1 | 3/2008 | Sharma et al. | |
| 2008/0094203 | A1 | 4/2008 | Kogan et al. | |

* cited by examiner

*Primary Examiner* — George Bugg
*Assistant Examiner* — Edny Labbees
(74) *Attorney, Agent, or Firm* — Taft Stettinius & Hollister LLP; Keith J. Swedo, Esq.

(57) ABSTRACT

A security system includes a perimeter sensor configured to cause an alarm signal to be issued after a first period of time upon sensing a security breach. An interior sensor is configured to cause an alarm signal to be issued after a second period of time upon sensing a security breach. The second period of time is shorter than the first period of time. A controller is communicatively coupled to each of the perimeter sensor and the interior sensor. The controller is adapted, in response to the perimeter sensor entering into a fault condition, to reconfigure the interior sensor to cause an alarm signal to be issued after a third period of time upon sensing a security breach. The third period of time is longer than the second period of time.

20 Claims, 4 Drawing Sheets

METHOD AND APPARATUS FOR CONTROLLING THE TIMING OF AN ALARM SIGNAL IN A SECURITY SYSTEM

BACKGROUND OF THE INVENTION

1. Field of the Invention

The present invention relates to surveillance systems, and, more particularly, to security systems that receive signals from discrete sensors.

2. Description of the Related Art

Surveillance systems, also known as security systems, are known to include security devices, such as motion detectors, door sensors, window sensors, smoke detectors, etc., for monitoring a secured area of space. Most security systems have a range or variety of sensors to which the security system is connected. The manufacturers of the security systems develop sensors specifically for, and to be compatible with, their security systems. These sensors may be either hardwired to the system or may be in communication with the system via a wireless medium.

The security system may issue an alarm signal in response to one or more of the sensors detecting an event, such as a door or window opening, or the presence of a person within the secured area. The alarm signal may cause an audible alarm signal, such as a siren, to be issued. Alternatively, or in addition, the alarm signal may be electronically transmitted to a central monitoring station from which police may be summoned to investigate the breach of the security system. However, for a first type of sensor, sometimes referred to as a "perimeter sensor," a grace period or "delay time" is provided between the tripping of the sensor and the issuance of the alarm signal. Such perimeter sensors are typically provided at exterior doors through which authorized users enter the premises. The delay time allows the authorized user to disarm the security system by entering a code at a control panel before the alarm signal is issued. For a second type of sensor, sometimes referred to as an "interior sensor," no such delay time is provided between the tripping of the sensor and the issuance of the alarm signal. Such interior sensors are typically provided at locations at which an authorized user returning to the premises would not initially be sensed, such as within the interior of the building or at a window, for example.

When planning to leave the secured premises unoccupied, the user may arm the security system by entering a code into the control panel. The user is then typically provided with an arming exit delay time to leave the premises before the sensors are activated and the protection is thereby turned on. When a perimeter sensor is faulted (i.e., is found to not be operating correctly) at the end of the arming exit delay time, the faulted perimeter sensor is normally bypassed and a report of the malfunction is sent to central monitoring station and/or is displayed on the control panel. The control panel may also decide not to arm and declare an exit error, including sending a report of that exit error. In the first scenario, after the bypassing of the faulty perimeter sensor, the security system has no active perimeter sensor to initiate the entry delay timer. Thus, the possibility for false alarms is increased because interior sensors generate instant alarms before an authorized user has a chance to disarm the security system. That is, a delay time is not provided between the sensing of an event by the system and the issuance of an alarm signal.

What is needed in the art is a security system that can operate with a perimeter sensor faulted while avoiding false alarms in the form of instant alarms generated by interior sensors.

SUMMARY OF THE INVENTION

The present invention provides a method of reducing false alarms in a security system. When a perimeter point is faulted at the end of the arming exit delay time (i.e., when protection is turned on) of an alarm system, the normal operation is that the point is bypassed and a report of that is sent to the reporting destinations(s). The system then has no active perimeter point to initiate an entry delay timer, and the possibility for false alarms increases, as interior points will generate instant alarms. According to the invention, when the panel bypasses the perimeter exit/entry point, it then turns all of the interior points into exit/entry points that are configured to initiate an entry delay. Thus, false alarms and customer annoyances are reduced.

The invention comprises, in one form thereof, a security system including a perimeter sensor configured to cause an alarm signal to be issued after a first period of time upon sensing a security breach. An interior sensor is configured to cause an alarm signal to be issued after a second period of time upon sensing a security breach. The second period of time is shorter than the first period of time. A controller is communicatively coupled to each of the perimeter sensor and the interior sensor. The controller is adapted, in response to the perimeter sensor entering into a fault condition, to reconfigure the interior sensor to cause an alarm signal to be issued after a third period of time upon sensing a security breach. The third period of time is longer than the second period of time.

The invention comprises, in another form thereof, a security system including a perimeter sensor configured to cause an alarm signal to be issued if the security system has not been disarmed within a first delay time period after sensing a security breach. An interior sensor is configured to cause an alarm signal to be issued substantially instantaneously upon sensing a security breach. A controller is communicatively coupled to each of the perimeter sensor and the interior sensor. The controller is adapted, in response to the perimeter sensor entering into a fault condition, to reconfigure the interior sensor to cause an alarm signal to be issued if the security system has not been disarmed within a second delay time period after sensing a security breach.

The invention comprises, in yet another form thereof, a method of operating a security system, including providing a perimeter sensor and an interior sensor within a space to be monitored. The security system is configured to cause an alarm signal to be issued after a first period of time upon the perimeter sensor sensing a security breach. The security system is configured to cause an alarm signal to be issued after a second period of time upon the interior sensor sensing a security breach. The second period of time is shorter than the first period of time. A controller is communicatively coupled to each of the perimeter sensor and the interior sensor. The controller is used, in response to the perimeter sensor entering into a fault condition, to reconfigure the security system to cause an alarm signal to be issued after a third period of time upon the interior sensor sensing a security breach. The third period of time is longer than the second period of time.

An advantage of the present invention is that it avoids false alarms caused by the lack of delay time associated with interior sensors.

Another advantage of the present invention is that the security system may still be operable in the event of a fault condition in a perimeter sensor.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
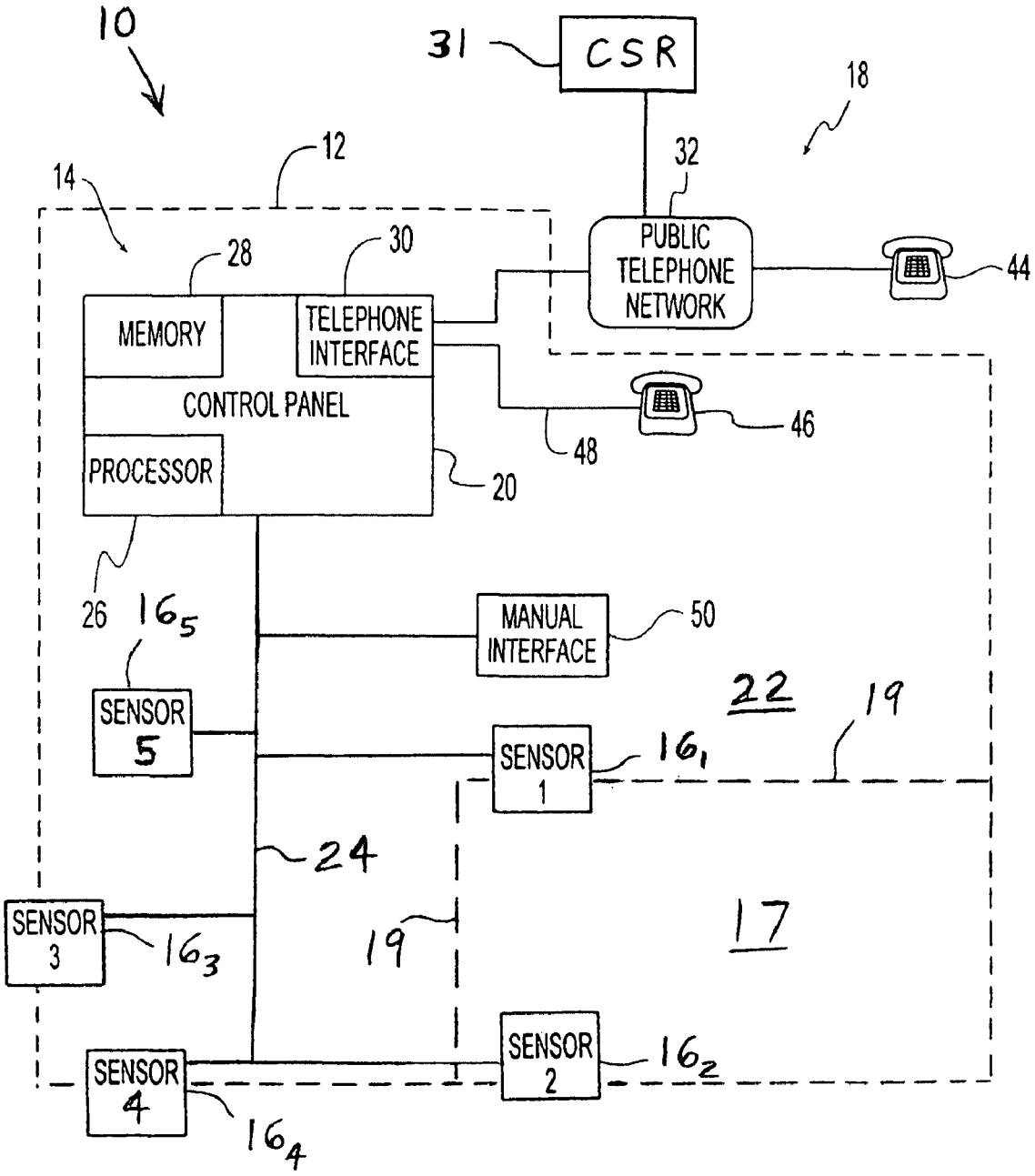
FIG. 1 is a block diagram of one embodiment of a security system of the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Referring now to the drawings and particularly to FIG. 1, there is shown one embodiment of a security system 10 of the present invention for a structure 12 such as a building. However, system 10 may be used to secure other spaces, such as outdoor areas, subterranean rooms and passages, and zones of air space. System 10 includes a system controller 14, security sensors $\mathbf{16}_1$, $\mathbf{16}_2$, $\mathbf{16}_3$, $\mathbf{16}_4$, $\mathbf{16}_5$ and an installer interface 18. Each of security sensors $\mathbf{16}_1$, $\mathbf{16}_2$, $\mathbf{16}_3$, $\mathbf{16}_4$, $\mathbf{16}_5$ may be any type of sensor that is capable of detecting the presence of a person and/or detecting some movement of an object caused by the person.

In one particular embodiment, sensors $\mathbf{16}_1$, $\mathbf{16}_2$ and $\mathbf{16}_3$ are door sensors, i.e., sensors that detect a door being opened; sensor $\mathbf{16}_4$ is a window sensor; and sensor $\mathbf{16}_5$ is a motion sensor. Sensor $\mathbf{16}_2$ monitors a door that leads between the outdoors and the inside of a garage 17 defined in FIG. 1 by the dashed rectangle 19. Sensor $\mathbf{16}_1$ monitors a door that leads between the inside of garage 17 and an interior 22 of structure 12 where people may live or work. Sensor $\mathbf{16}_3$ monitors a door that leads between the outdoors and interior 22 of structure 12. Sensor $\mathbf{16}_4$ monitors a window that separates the outdoors and interior 22 of structure 12. Sensor $\mathbf{16}_5$ monitors interior 22 of structure 12 for movement and/or the presence of a warm body within a line-of-sight of sensor $\mathbf{16}_5$.

System controller 14 includes a control device in the form of a control panel 20 electrically connected via an option bus 24 to each of security sensors $\mathbf{16}_1$, $\mathbf{16}_2$, $\mathbf{16}_3$, $\mathbf{16}_4$, $\mathbf{16}_5$. Door sensors $\mathbf{16}_1$, $\mathbf{16}_2$ and $\mathbf{16}_3$ may be perimeter sensors in that the sensing of a security breach by one of sensors $\mathbf{16}_1$, $\mathbf{16}_2$ and $\mathbf{16}_3$ in the form of a door opening does not instantaneously result in an alarm signal being issued by control panel 20. Rather, an alarm signal may be issued only if a predetermined period of time, or a "grace period" passes after the sensing of the security breach without the user disarming system 10 such as by keying a code into manual interface 50. Although all of the perimeter sensors shown in FIG. 1 are in the form of door sensors, it is to be understood that other types of security sensors may also serve as perimeter sensors.

Window sensor $\mathbf{16}_4$ and motion sensor $\mathbf{16}_5$ may be interior sensors in that the sensing of a security breach by one of sensors $\mathbf{16}_4$, $\mathbf{16}_5$ in the form of a window opening or human presence does instantaneously, or nearly instantaneously, result in an alarm signal being issued by control panel 20. However, it is possible that an instantaneous alarm signal does not result from the detection of a security breach by one or both of sensors $\mathbf{16}_4$, $\mathbf{16}_5$ if the alarm signal is currently being inhibited by one of perimeter sensors $\mathbf{16}_1$, $\mathbf{16}_2$ and $\mathbf{16}_3$. That is, if operation is currently within the delay time period or grace period after the sensing of a breach by one of perimeter sensors $\mathbf{16}_1$, $\mathbf{16}_2$ and $\mathbf{16}_3$, then an alarm signal resulting from interior sensors $\mathbf{16}_4$, $\mathbf{16}_5$ may also be inhibited during the grace period.

Although five sensors 16 are shown in FIG. 1, it is to be understood that security system 10 may include any number of sensors 16. Further, sensors 16 may include any number of perimeter sensors and any number of interior sensors.

Control panel 20 may include a processor 26, a memory device 28 and a telephone interface 30. Processor 26 may coordinate communication with the various system components including installer interface 18. Memory 28 may include software for interpreting signals from sensors 16, installer interface 18, and manual interface 50 and deciding based thereon whether to transmit an alarm signal from control panel 20. Memory 28 may also serve as a database for sensors 16. The alarm signal may be used to activate an audible alarm (not shown) within building 12, or to notify a central monitoring station or "central station receiver" (CSR) 31 such as a security company, fire station, or police station, for example, via public switched telephone network 32. Network 32 may otherwise be known as the network of the world's circuit-switched telephone networks. Memory 28 may also store identification information and configuration data for sensors 16.

Installer interface 18 may include an outside communication device 44, such as a cell phone, standard phone, or computer equipped with a modem; a house phone 46, which may be hard-wired to telephone interface 30 via a telephone line 48; and manual interface 50, which may be in the form of a keypad. Manual interface 50 may be in communication with control panel 20 via option bus 24. Thus, installer interface 18 may be in communication with system controller 14 via public telephone network 32, telephone line 48, and/or option bus 24. Installer interfaces including Ethernet or a networked connection are also possible.

Upon being armed by a user, such as by the user keying a code into manual interface 50, security system 10 may enter an operational mode in which system 10 performs its intended function of providing surveillance. In the operational mode, sensors 16 continue to report their statuses according to and dependent upon their configurations, and system controller 14 continues to monitor sensors 16 according to and dependent upon the configurations of sensors 16.

There may be an occasion when the default configuration that control system 14 has assigned to a sensor 16 needs to be changed to suit a particular application. In order to modify the configuration of a device, a user may access manual interface 50 and key in replacement configuration data for the device.

During use, sensors 16 may detect a breach of security and respond thereto by transmitting a sensor signal to control panel 20. Depending upon the configuration of the detecting sensor, an alarm signal may be issued immediately, or only after the expiration of a delay time period if there has been no disarming of the security system by the user.

Figure 2:
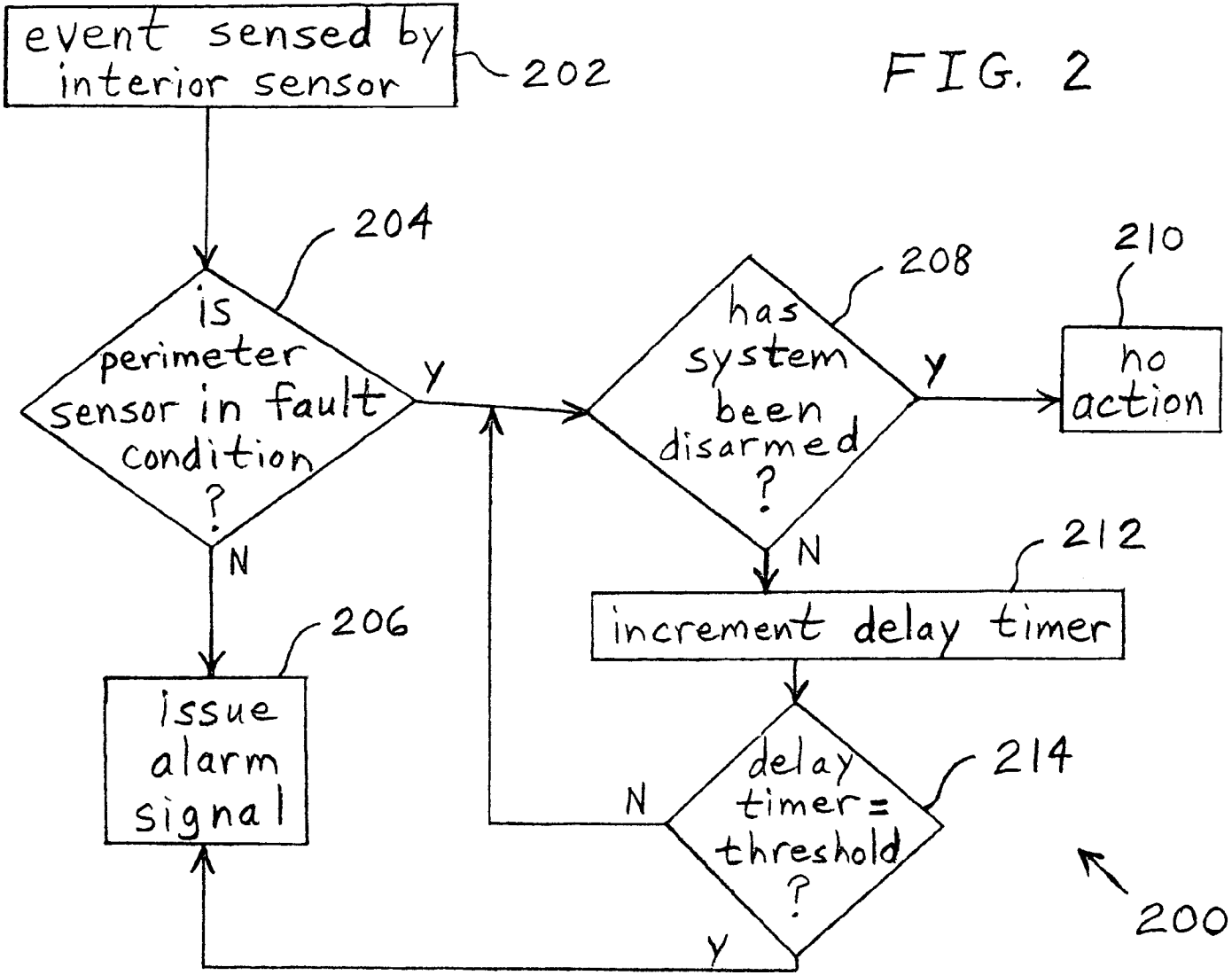
FIG. 2 is a flow chart of one embodiment of a method of the present invention for operating a security system.

One embodiment of a method 200 of the present invention for operating a security system is illustrated in FIG. 2. In a first step 202, an event, such as a security breach, is sensed by one of interior sensors $\mathbf{16}_4$, $\mathbf{16}_5$. For example, interior sensor $\mathbf{16}_4$ may sense the opening of a window, or sensor $\mathbf{16}_5$ may sense motion or otherwise sense the presence of a person within structure 12.

In a second step 204, it is determined whether one of the perimeter sensors is in a fault condition. For example, during a sensor interrogation process, it may be determined whether each of perimeter sensors $16_1$, $16_2$ and $16_3$ is functioning properly. The sensor interrogation process may have occurred before step 202, and the results of the interrogation process may be retrieved from memory during step 204. The failure mode of a faulted perimeter sensor may be that the sensor constantly indicates a security breach when none in fact exists; the sensor constantly indicates that there is no security breach when one in fact does exist; or the sensor is unable to communicate.

If it is determined in step 204 that no perimeter sensor is in a fault condition, then operation proceeds to step 206 wherein an alarm signal is issued in response to the security breach sensed in step 202. That is, an audible device may emit a siren or other loud noise in the vicinity of structure 12. Alternatively, or in addition, an electronic alarm signal may be transmitted from control panel 20 to CSR 31 so that personnel at CSR 31 may investigate the security breach that was detected in step 202.

If it is determined in step 204 that a perimeter sensor is in a fault condition, then operation proceeds to step 208 wherein it is determined whether the system has been disarmed. For example, it is determined whether the user has keyed in a disarming code into manual interface 50 since the time at which the security breach was sensed in step 202.

If it is determined in step 208 that the user has indeed disarmed the security system, then no action is taken (step 210). That is, no alarm signal is issued and the system waits to be re-armed.

If, however, it is determined in step 208 that the user has not disarmed the security system, then operation proceeds to step 212 wherein a delay timer is incremented. Next, in step 214 it is determined whether the value of the delay timer after being incremented is equal to a threshold value. In one particular embodiment, the threshold value of the delay timer is equivalent to a time period of about thirty seconds. However, the threshold value may be selected to be any value that provides enough time for the user to enter a disarming code into manual interface 50.

If, in step 214, the value of the delay timer is not equal to the threshold value (i.e., is less than the threshold value), then operation returns to step 208 where it is again determined whether the user has yet disarmed the security system. If the user has indeed disarmed the system, then no action is taken (step 210) and the system waits to be re-armed. If, however, in step 208 it is determined that the system has not been disarmed, then the delay timer is again incremented (step 212). Then it is again checked in step 214 whether the delay timer has reached the threshold value. This process loop including steps 208, 212 and 214 continues until the expiration of the delay time period (thirty seconds in one embodiment), at which time it is determined in step 214 that the value of the delay timer is indeed equal to the threshold value. Operation then proceeds to step 206 wherein an alarm signal is issued.

In method 200, both interior sensors $16_4$, $16_5$ are reconfigured in the same way in response to one of perimeter sensors $16_1$, $16_2$ and $16_3$ being in a fault condition. That is, both interior sensors $16_4$, $16_5$ are provided with a delay time period before their sensing of a security breach can result in an alarm signal being issued. However, in another embodiment, interior sensors $16_4$, $16_5$ are reconfigured differently from each other in response to one of perimeter sensors $16_1$, $16_2$ and $16_3$ being in a fault condition. That is, in one embodiment, interior sensor $16_5$ is reconfigured with a delay time period, but sensor $16_4$ is not reconfigured with a delay time period in response to a fault in a perimeter sensor. A rationale for this different reconfiguration of interior sensors $16_4$, $16_5$ is that an authorized person may normally be sensed by interior sensor $16_5$ when walking to manual interface 50 to enter the disarming code, but an authorized person would not normally open the window monitored by interior sensor $16_4$ before entering the disarming code. Thus, if interior sensor $16_4$ senses a security breach, it is less likely to be a false alarm and more likely to be caused by an intruder than if interior sensor $16_5$ senses a security breach.

Likewise, in method 200, a fault in any of perimeter sensors $16_1$, $16_2$ and $16_3$ results in the same reconfiguration of interior sensors $16_4$, $16_5$. However, in another embodiment, faults in individual ones of perimeter sensors $16_1$, $16_2$ and $16_3$ may affect the reconfiguration of interior sensors $16_4$, $16_5$ differently. For instance, a fault in perimeter sensor $16_2$ alone may not result in any reconfiguration in interior sensors $16_4$, $16_5$ because a person entering garage area 17 via the door monitored by perimeter sensor $16_2$ would still need to pass through the door monitored by perimeter sensor $16_1$ before being sensed by interior sensors $16_4$, $16_5$. Thus, even if perimeter sensor $16_2$ is faulted, a delay time period would still be provided by the tripping of perimeter sensor $16_1$, which would provide enough time to enable an authorized user to enter a disarming code. Conversely, a fault in perimeter sensor $16_1$ alone may result in a reconfiguration in interior sensors $16_4$, $16_5$ because a person may enter garage area 17 via an unmonitored car door (not shown). Thus the person may not receive the benefit of the grace period that would have been provided by tripping perimeter sensor $16_2$, and hence interior sensors $16_4$, $16_5$ may be reconfigured to provide the needed grace period. The logic associated with perimeter sensor $16_3$ may be the same as that of perimeter sensor $16_1$, and thus a fault in perimeter sensor $16_3$ may result in a reconfiguration in interior sensors $16_4$, $16_5$ to provide an alarm signal delay time period.

Figure 3:
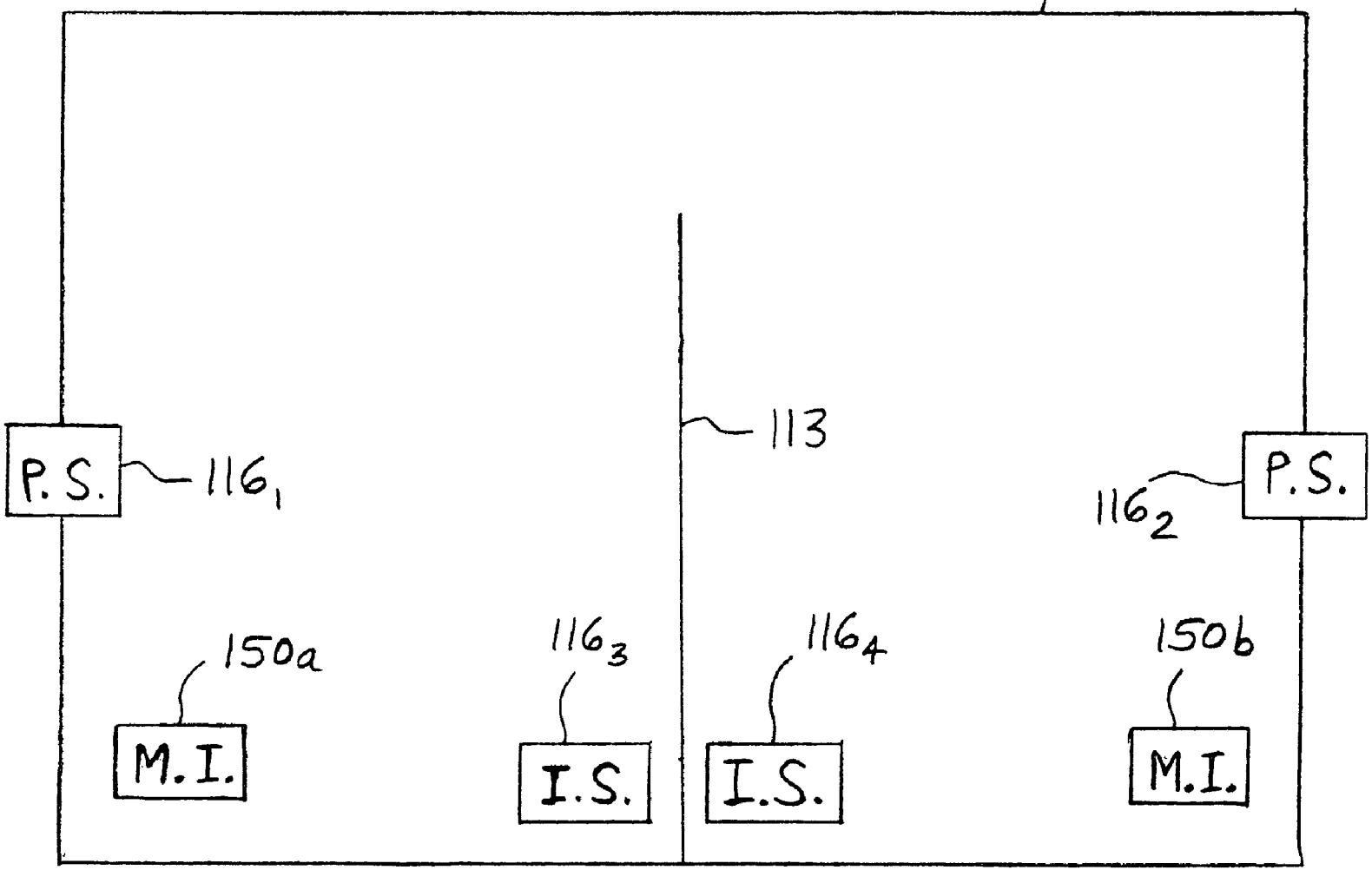
FIG. 3 is a block diagram of another embodiment of a security system of the present invention.

Referring now to FIG. 3, there is partially illustrated another embodiment of a security system of the present invention for a building 112 which includes an internal wall 113. The system includes a perimeter sensor $116_1$, an interior sensor $116_3$ and a manual interface 150*a* on one side of wall 113; and a perimeter sensor $116_2$, an interior sensor $116_4$ and a manual interface 150*b* on another side of wall 113. Perimeter sensors $116_1$, $116_2$ may each monitor the opening of a respective door, and interior sensors $116_3$, $116_4$ may each monitor a respective area of space on a respective side of wall 113 for the presence of a human being. The system may include a control panel and the other system components shown in FIG. 1, but these components may be on a floor of building 112 other than the first floor shown in FIG. 3.

Upon installation and/or arming of the security system, perimeter sensors $116_1$, $116_2$ may be configured with a delay time period before an alarm signal is issued after a detected security breach. That is, after one of perimeter sensors $116_1$, $116_2$ detects the opening of a respective door, a delay time of about thirty seconds may be provided before an alarm signal is issued. The delay time enables an authorized user of the system to key a code into one of manual interfaces 150*a*, 150*b* to thereby disable or disarm the system and prevent the issuance of a false alarm signal. However, interior sensors $116_3$, $116_4$ are not configured with any such delay time period. Consequently, the detection of human presence within the spaces monitored by interior sensors $116_3$, $116_4$ (without the existence of a currently-active delay time period that was caused by the perimeter sensors) may result in instantaneous issuance of an alarm signal. Thus, interior sensors $116_3$, $116_4$ may appropriately cause an alarm signal to be instantaneously issued in response to an intruder entering the monitored space within building 112 via a window, ceiling, or a staircase from another floor, for example.

According to one embodiment of the invention, a fault condition in one of the perimeter sensors $116_1$, $116_2$ results in the reconfiguration of the interior sensor that is on the same side of wall 113 as the faulted perimeter sensor, but does not result in the reconfiguration of the interior sensor that is on the opposite side of wall 113 as the faulted perimeter sensor. For example, if it is sensed that perimeter sensor $116_1$ is in a faulted condition, then interior sensor $116_3$ is reconfigured with a delay time period, but interior sensor $116_4$ is not reconfigured with a delay time period. Reasons for the near interior sensor being reconfigured and the far interior sensor not being reconfigured is that, while the near interior sensor $116_3$ will likely be tripped by a person coming through the door normally monitored by the faulted perimeter sensor $116_1$, the far interior sensor $116_4$ will likely not be tripped by a person coming through the door normally monitored by the faulted perimeter sensor $116_1$ because wall 113 blocks the ability of interior sensor $116_4$ to detect the presence of the person.

Interior sensor $116_3$ may be reconfigured with a delay time period that is equal to the delay time period associated with perimeter sensor $116_1$, or interior sensor $116_3$ may be reconfigured with a delay time period that is different from the delay time period associated with perimeter sensor $116_1$. For example, in one specific embodiment, perimeter sensor $116_1$ is associated with a delay time period of sixty seconds, and interior sensor $116_3$, as reconfigured, is associated with a delay time period of thirty seconds.

Reasons for a lesser delay time period associated with an interior sensor include the person having completed entering building 112 by the time he is detected by the interior sensor. Thus, an authorized user does not need as much time to key in an authorization code by the time he is detected by the interior sensor. Another reason is that the person is closer to both the manual interface and valuables to be secured within building 112 by the time he is detected by the interior sensor. Thus, an intruder is closer to stealing the valuables within building 112 by the time he is detected by the interior sensor. Also, there is greater certainty that the person poses a threat if he is detected by an interior sensor. For these reasons, it may be advantageous for an interior sensor to be provided with a shorter delay time period than is a perimeter sensor.

In one embodiment, a series of audio tones is provided by the manual interface during the running of the delay time period in order to bring to the attention of an authorized user the fact that he must disarm the system to prevent an alarm signal from being issued. Some characteristic of the series of audio tones may vary according to the length of the delay time period provided in order to give an authorized user some indication of the urgency of disarming the security system. In a specific embodiment, the shorter delay time period associated with the tripping of an interior sensor may result in a greater number of audio tones or "beeps" within a unit time than does the longer delay time period associated with the tripping of a perimeter sensor. In another embodiment, the shorter delay time period associated with the tripping of an interior sensor may result in audio tones of a higher frequency or pitch as compared to the audio tones resulting from the tripping of a perimeter sensor with its associated longer delay time period.

Figure 4:
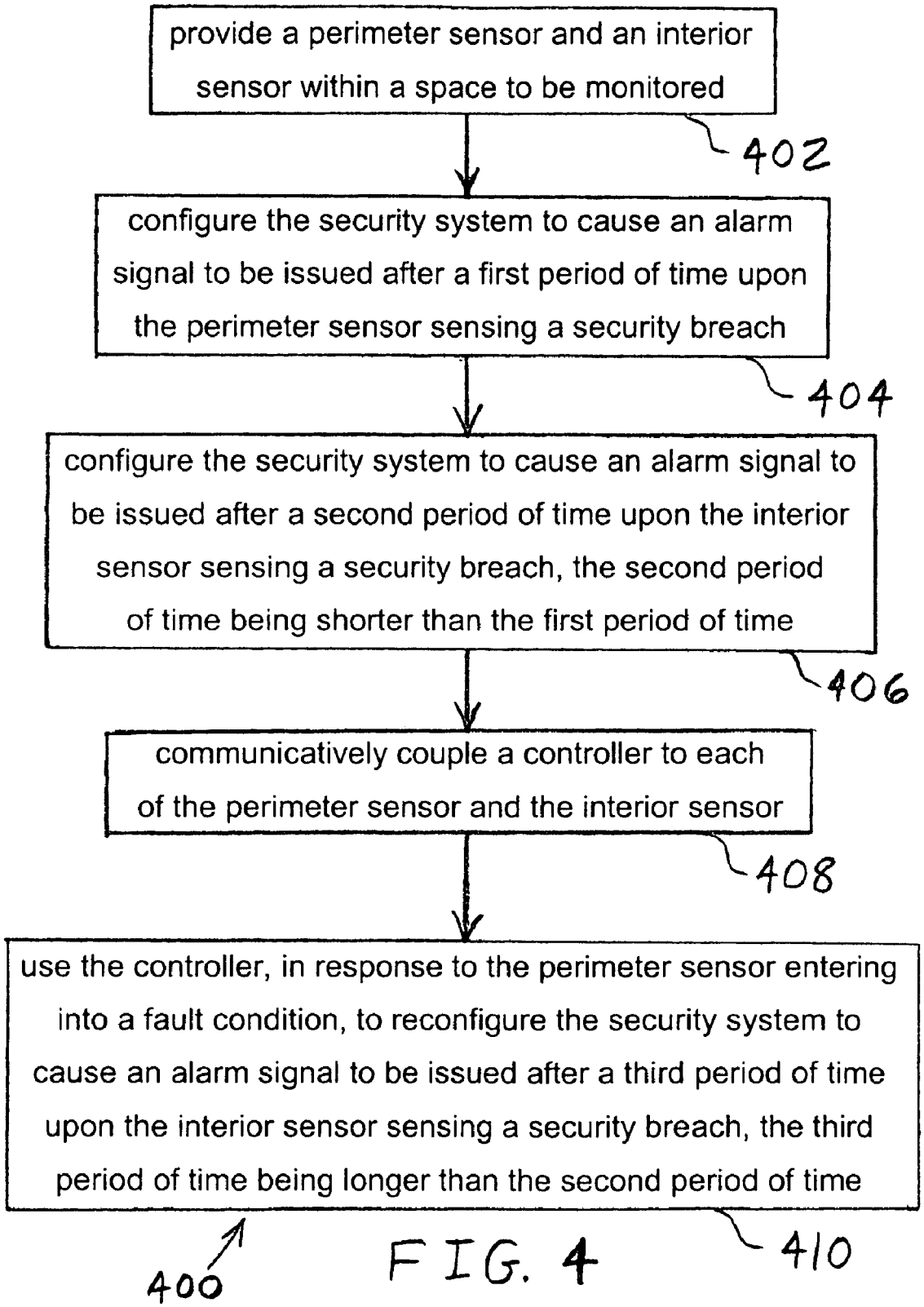
FIG. 4 is a flow chart of another embodiment of a method of the present invention for operating a security system.

Another embodiment of a method 400 for operating a security system is illustrated in FIG. 4. In a first step 402, a perimeter sensor and an interior sensor are provided within a space to be monitored. For example, in the embodiment of FIG. 1, perimeter sensor $16_1$ and interior sensor $16_5$ may be provided within an interior space 22 to be monitored within structure 12.

In a next step 404, the security system is configured to cause an alarm signal to be issued after a first period of time upon the perimeter sensor sensing a security breach. In one specific embodiment, security system 10 is configured to cause an alarm signal to be issued once a thirty second delay time has passed after perimeter sensor $16_1$ has sensed a security breach. The other sensors $16_2$, $16_3$ and $16_4$ may also be considered to be within interior space 22 as defined herein.

Next, in step 406,the security system is configured to cause an alarm signal to be issued after a second period of time upon the interior sensor sensing a security breach, the second period of time being shorter than the first period of time. For example, security system 10 may be configured to cause an alarm signal to be issued substantially instantaneously upon the interior sensor $16_5$ sensing a security breach. However, the invention also applies to embodiments in which an alarm system is initially configured to issue an alarm signal once a non-zero period of time has passed after the sensing of a security breach by an interior sensor.

In step 408, a controller is communicatively coupled to each of the perimeter sensor and the interior sensor. In the embodiment of FIG. 1, control panel 20 is communicatively coupled to each of perimeter sensor $16_1$ and interior sensor $16_5$ via bus 24.

In a final step 410, the controller, in response to the perimeter sensor entering into a fault condition, is used to reconfigure the security system to cause an alarm signal to be issued after a third period of time upon the interior sensor sensing a security breach, the third period of time being longer than the second period of time. For example, control panel 20, in response to perimeter sensor $16_1$ entering into a fault condition, may reconfigure security system 10 to cause an alarm signal to be issued thirty seconds after interior sensor $16_1$ senses the presence of a human being. In embodiments in which a non-zero delay time period is initially associated with an interior sensor, the non-zero delay time period may be lengthened in response to a perimeter sensor going into a fault condition. The lengthened non-zero delay time period may be less than or equal to the delay time period initially associated with the faulted perimeter sensor.

The present invention has been described herein in connection with sensors that are hardwired to the control panel. However, it is to be understood that the present invention is equally applicable to wireless security sensors.

While this invention has been described as having an exemplary design, the present invention may be further modified within the spirit and scope of this disclosure. This application is therefore intended to cover any variations, uses, or adaptations of the invention using its general principles.

What is claimed is:

1. A security system, comprising:

a perimeter sensor configured to cause an alarm signal to be issued after a first period of time upon sensing a security breach;

an interior sensor configured to cause an alarm signal to be issued after a second period of time upon sensing a security breach, the second period of time being shorter than the first period of time; and a controller communicatively coupled to each of the perimeter sensor and the interior sensor, the controller being adapted, in response to the perimeter sensor entering into a fault condition, to reconfigure the interior sensor to cause an alarm signal to be issued after a third period of time upon sensing a security breach, the third period of time being longer than the second period of time.

2. The system of claim 1 wherein the second period of time is less than one second.

3. The system of claim 1 wherein the perimeter sensor comprises a door sensor.

4. The system of claim 1 wherein the interior sensor comprises a motion sensor.

5. The system of claim 1 wherein the third period of time is substantially equal to the first period of time.

6. The system of claim 1 wherein the controller is configured to prevent the issuance of the alarm signal in response to a user disarming the security.

7. The system of claim 1 wherein the third period of time is shorter than the First period of time.

8. A security system, comprising:

a perimeter sensor configured to cause an alarm signal to be issued if the security system has not been disarmed within a first delay time period after sensing a security breach;

an interior sensor configured to cause an alarm signal to be issued substantially instantaneously upon sensing a security breach; and a controller communicatively coupled to each of the perimeter sensor and the interior sensor, the controller being adapted, in response to the perimeter sensor entering into a fault condition, to reconfigure the interior sensor to cause an alarm signal to be issued if the security system has not been disarmed within a second delay time period after sensing a security breach.

9. The system of claim 8 wherein the perimeter sensor comprises a door sensor.

10. The system of claim 8 wherein the interior sensor comprises a motion sensor.

11. The system of claim 8 wherein the second delay time period is substantially equal to the first delay time period.

12. The system of claim 8 wherein the controller is configured to prevent the Issuance of the alarm signal in response to a user disarming the security.

13. The system of claim 8 wherein the second delay time period is shorter than the first delay time period.

14. A method of operating a security system, the method comprising the steps of:

providing a perimeter sensor and an interior sensor within a space to be monitored;

configuring the security system to cause an alarm signal to be issued after a first period of time upon the perimeter sensor sensing a security breach;

configuring the security system to cause an alarm signal to be issued after a second period of time upon the interior sensor sensing a security breach, the second period of time being shorter than the first period of time;

communicatively coupling a controller to each of the perimeter sensor and the interior sensor; and using the controller, in response to the perimeter sensor entering into a fault condition, to reconfigure the security system to cause an alarm signal to be issued after a third period of time upon the interior sensor sensing a security breach, the third period of time being longer than the second period of time.

15. The method of claim 14 wherein the perimeter sensor comprises a door sensor.

16. The method of claim 14 wherein the interior sensor comprises a motion sensor.

17. The method of claim 14 wherein the third period of time is substantially equal to the first period of time.

18. The method of claim 14 comprising, after the sensing of the security breach, the further steps of:

disarming the security system; and preventing the issuance of the alarm signal in response to the disarming of the security system.

19. The method of claim 14 wherein the third period of time is shorter than the first period of time.

20. The method of claim 14 comprising the further step of receiving the alarm signal at a central monitoring station.

* * * * *